US005739646A

United States Patent [19]

Nakanishi et al.

[11] Patent Number: 5,739,646

[45] Date of Patent: Apr. 14, 1998

[54] MAGNETIC FIELD ADJUSTING CENTER RODS FOR CYCLOTRON A MAGNET FOR CYCLOTRON, AND CYCLOTRON

[75] Inventors: Noriyoshi Nakanishi, Saitama-ken; Shuichiro Wakase, Hokkaido; Takashi Karasawa, Tokyo-to, all of Japan

[73] Assignees: The Institute of Physical and Chemical Research, Wako; Ion Kasokuki Kabushiki Kaisha, Hakodate, both of Japan

[21] Appl. No.: 733,264

[22] Filed: Oct. 17, 1996

[30] Foreign Application Priority Data

Oct. 17, 1995 [JP] Japan ..... 7-311714

[51] Int. Cl.[6] ..... H05H 13/00

[52] U.S. Cl. ..... 315/502; 315/500; 313/62

[58] Field of Search ..... 315/502, 507, 315/500; 335/210; 313/62

[56] References Cited

U.S. PATENT DOCUMENTS 3,175,131 3/1965 Burleigh et al. ..... 317/158

4,641,104 2/1987 Blosser et al. ..... 328/234

4,996,496 2/1991 Kitamura et al. ..... 313/62

OTHER PUBLICATIONS

Patent Abstracts of Japan, vol. 2, No. 151, Dec. 18, 1978 & JP53120099 (Japan Steel Works Ltd.).

*Primary Examiner*—Sandra L. O'Shea

*Assistant Examiner*—Joseph Williams

*Attorney, Agent, or Firm*—Jacobson, Price, Holman & Stern, PLLC

[57] ABSTRACT

A pair of magnetic field adjusting center rods are inserted in central portions of a pair of pole pieces of a magnet included in a cyclotron. One of the magnetic field adjusting center rods is provided with an ion source receiving hole and the other is provided with a magnetic field adjusting recess coaxially with the ion source receiving hole. The magnetic field adjusting center rods are provided at their ends facing each other with magnetic field correcting projections, respectively. The magnetic field correcting projections project toward each other to form pole faces facing each other with a small air gap. Thus, irregularities in a magnetic field created between the pole pieces are corrected so that the dispersion of ion beams and the distortion of an orbit of ions can be prevented.

19 Claims, 5 Drawing Sheets

MAGNETIC FIELD ADJUSTING CENTER RODS FOR CYCLOTRON A MAGNET FOR CYCLOTRON, AND CYCLOTRON

BACKGROUND OF THE INVENTION

1. Field of the Invention

The present invention relates to a pair of magnetic field adjusting rods axially movably inserted in the central bores of a pair of opposite pole pieces of a magnet, i.e., a main magnet, included in a cyclotron, a magnet for a cyclotron, and a cyclotron.

2. Description of the Related Art

In a conventional cyclotron, distribution of magnetic flux density in a magnetic field created in an initial ion acceleration region by a magnet has no AVF (azimuthally varying field) and hence accelerated ions are liable to disperse in the axial directions of the magnetic poles. Therefore, a magnetic field is created so that the magnetic flux density of the magnetic field reaches a maximum in a region corresponding to the center of the magnet and decreases with the distance from the center as shown in FIG. 8 to prevent the axial dispersion of accelerated ions.

FIGS. 5 to 7 shows the structure of pole pieces of a magnet included in a general cyclotron, in which FIG. 5 is a schematic sectional view of the pole pieces, FIG. 6 is a view taken in the direction of the arrows along the line VI—VI in FIG. 5, and FIG. 7 is a diagrammatic view of assistance in explaining magnetic flux density distribution in a region around the center of the magnet. FIGS. 8 and 9 are graphs showing magnetic flux density distributions in a region around the center of the magnet.

Referring to FIGS. 5 to 7, an AVF electromagnet having a center axis A has a pair of pole pieces 21 and 22 disposed opposite to each other one over the other, the pole pieces 21 and 22 are provided with circular central bore s 21*a* and 22*a* coaxially with the center axis A and have lands 21*b* and 22*b*, and depressions 21*c* and 22*c*, respectively. A spiral C is an orbit of accelerated ions and lines D represent the edges of dees.

Center rods 11 and 12 of a magnetic material are inserted axially opposite to each other in the central bores 21*a* and 22*a*, respectively, so as to be movable along the center axis A. The upper center rod 11 is provided with an ion source receiving hole 11*a* extending along an axis B parallel to the center axis A, and the lower center rod 12 is provided with a magnetic field adjusting recess 12*a* having a diameter equal to that of the ion source receiving hole 11*a* and coaxial with the ion source receiving hole 11*a*.

The ion source receiving hole 11*a* and the magnetic field adjusting recess 12*a* are eccentric to the center rods 11 and 12, respectively. A cylindrical, nonmagnetic ion source bar 13 (FIG. 7) is inserted in the ion source receiving hole 11*a*. The ion source bar 13 is provided with an ion source cone 13 provided with an ion outlet at its extremity.

The center rods 11 and 12 have diameters corresponding to a region in which the AVF effect of the pole pieces 21 and 22 is ineffective. The vertical positions of the center rods 11 and 12 are adjusted so that a magnetic flux density distribution curve representing the distribution of magnetic flux density reaches a maximum in a central region of the pole pieces 21 and 22. When the center rods 11 and 12 are ideal center rods not provided with the ion source receiving hole 11*a* and the recess 12*a*, relative magnetic flux density $\Delta B/B_0$, where $\Delta B$ is magnetic flux density at a specified position and $B_0$ is mean magnetic field density, in a region around the center axis A in which AVF effect is ineffective is reduced about 2% as shown in FIG. 8, and the dispersion of ions in a Z-direction, i.e., a direction along the axis of the ion source receiving hole 11*a*, can be prevented.

However, since the ion source bar 13 is a nonmagnetic member and a portion of the pole piece 21 corresponding to the ion source receiving hole 11*a* is missing, the magnetic flux density distribution is disturbed. FIG. 9 shows a magnetic flux density distribution in a region around the axis B corresponding to the missing portion of the upper pole piece 21. The magnetic field adjusting recess 12*a* formed in the lower pole piece 22 is a missing portion of the lower pole piece 22 similar to that of the upper pole piece 21. The disturbance of the magnetic flux density distribution in this region entails the axial dispersion of accelerated ions and the distortion of ion orbit.

Such a phenomenon become more conspicuous when the interval between the pole pieces is reduced to miniaturize the cyclotron. When the magnetic filed has the magnetic flux density distribution as shown in FIG. 9, many ion beams experience a force tending to bias the ion beams in the direction of the axis A when passing the region around the missing portion and impinge on the end surface of an acceleration electrode and walls of a case and disappear, in an initial stage of acceleration in which ions move at a low speed in a circle of a small radius of curvature. Since the magnetic flux density distribution in this region is locally irregular with respect to a circumferential direction of the magnetic field, portions of the orbits of ions that have evaded colliding against the acceleration electrode and continue to move further are distorted in this region and, consequently, acceleration phase is shifted and the ions cannot be accelerated.

SUMMARY OF THE INVENTION

The present invention has been made to solve the foregoing problems and it is therefore an object of the present invention to provide magnetic field adjusting center rods for a cyclotron, for adjusting magnetic flux density distribution in a magnetic field created between a pair of pole pieces of a main electromagnet. The pair of magnetic field adjusting center rods are inserted in the central portions of the pair of pole pieces opposite to each other, respectively, so as to be movable along the center axis of the pole pieces, one of the magnetic field adjusting center rods is provided with an ion source receiving hole for receiving an ion source therein extending along the center axis of the pole pieces, the other magnetic field adjusting center rod is provided with a magnetic field adjusting recess, the ion source receiving hole and the magnetic field adjusting recess has a common axis, and the pair of magnetic field adjusting center rods are provided with magnetic field correcting projections for correcting irregularities in magnetic flux density distribution in a region around the opposite open ends of the ion source receiving hole and the magnetic field adjusting recess.

Each of the magnetic field correcting projections may have an annular shape.

Each of the magnetic field correcting projections may have a circumferentially continuous annular shape.

Each of the magnetic field correcting projections may have a circumferentially intermittent annular shape.

Each of the magnetic field correcting projections may have an inside diameter equal to the diameter of the ion source receiving hole and the magnetic field adjusting recess.

Each of the magnetic field correcting projections may have an inside diameter greater than the diameter of the ion source receiving hole and the magnetic field adjusting recess.

Each of the magnetic field correcting projections may have an inside diameter smaller than the diameter of the ion source receiving hole and the magnetic field adjusting recess.

A projecting end portion of each of the magnetic field correcting projections may have a tapered cross section.

A projecting end portion of each of the magnetic field correcting projections may have a rounded cross section.

A projecting end portion of each of the magnetic field correcting projections may have a semicircular cross section.

A projecting end portion of each of the magnetic field correcting projections may have a triangular cross section.

A projecting end portion of each of the magnetic field correcting projections may have a trapezoidal cross section.

A magnet in accordance with the present invention for a cyclotron comprises a pair of pole pieces disposed opposite to each other, and a pair of magnetic field adjusting center rods disposed opposite to each other in central portions of the pair of pole pieces, respectively, so as to be movable along a common center axis of the pole pieces to adjust magnetic flux density distribution in a magnetic filed created between the pair of pole pieces of the magnet. One of the magnetic field adjusting center rods is provided with an ion source receiving hole for receiving an ion source therein extending along the common center axis of the pole pieces, the other magnetic field adjusting center rod is provided with a magnetic field adjusting recess, the ion source receiving hole and the magnetic field adjusting recess have a common axis, and the pair of magnetic field adjusting center rods are provided with magnetic field correcting projections for correcting irregularities in magnetic flux density distribution around the opposite open ends of the ion source receiving hole and the magnetic field adjusting recess, respectively.

A cyclotron according to the present invention comprises a magnet having a pair of pole pieces disposed opposite to each other, and a pair of magnetic field adjusting center rods disposed opposite to each other in central portions of the pair of pole pieces, respectively, so as to be movable along a common center axis of the pole pieces to adjust magnetic flux density distribution in a magnetic filed created between the pair of pole pieces of the magnet. One of the magnetic field adjusting center rods is provided with an ion source receiving hole for receiving an ion source therein extending along the common center axis of the pole pieces, the other magnetic field adjusting center rod is provided with a magnetic field adjusting recess, the ion source receiving hole and the magnetic field adjusting recess have a common axis, and the pair of magnetic field adjusting center rods are provided with magnetic field correcting projections for correcting irregularities in magnetic flux density distribution around the opposite open ends of the ion source receiving hole and the magnetic field adjusting recess, respectively.

The ion source receiving hole and the magnetic field adjusting recess are substantially missing portions in the magnetic field adjusting center rods. However, since the pair of magnetic field adjusting center rods of the present invention are provided with the pair of magnetic field correcting projections for correcting the irregularities in the magnetic flux density distribution around the opposite open ends of the ion source receiving hole and the magnetic field adjusting recess, respectively, the end surfaces of the pair of magnetic field correcting projections form pole faces close to each other. Therefore, irregularities in the magnetic field due to the ion source receiving hole and the magnetic field adjusting recess facing the ion source receiving hole can be corrected and, consequently, the dispersion of ion beams in the initial stage of acceleration can be suppressed, the distortion of the orbit of ions can be limited to the least extent and ions can normally be accelerated.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
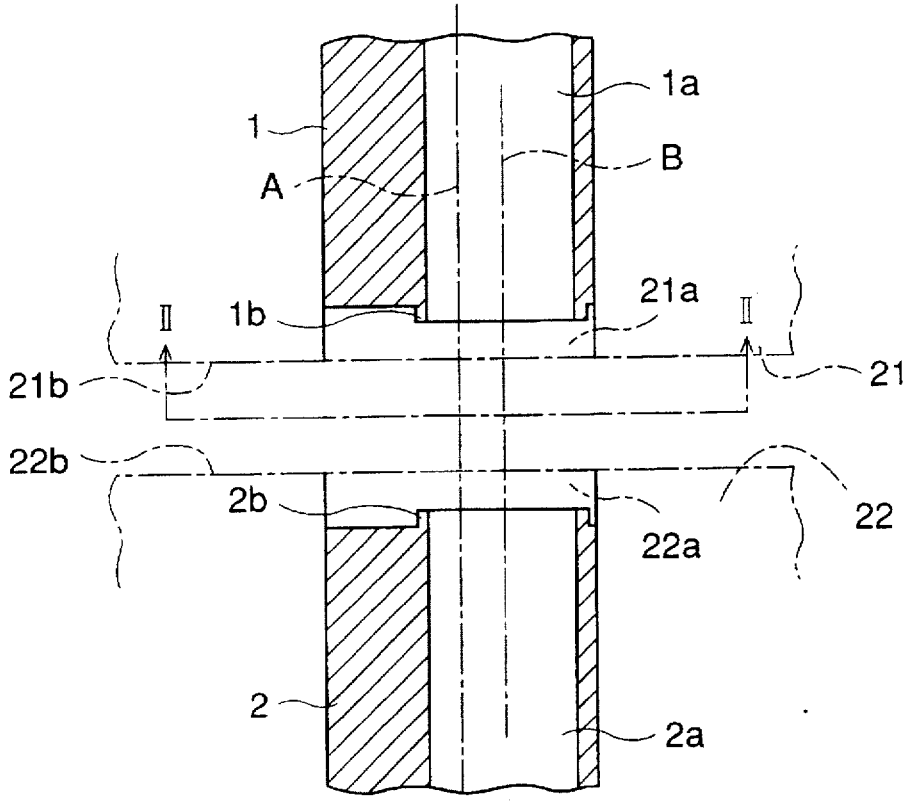
FIG. 1 is a sectional view of magnetic field adjusting center rods in a preferred embodiment according to the present invention as mounted on a cyclotron.
Figure 2:
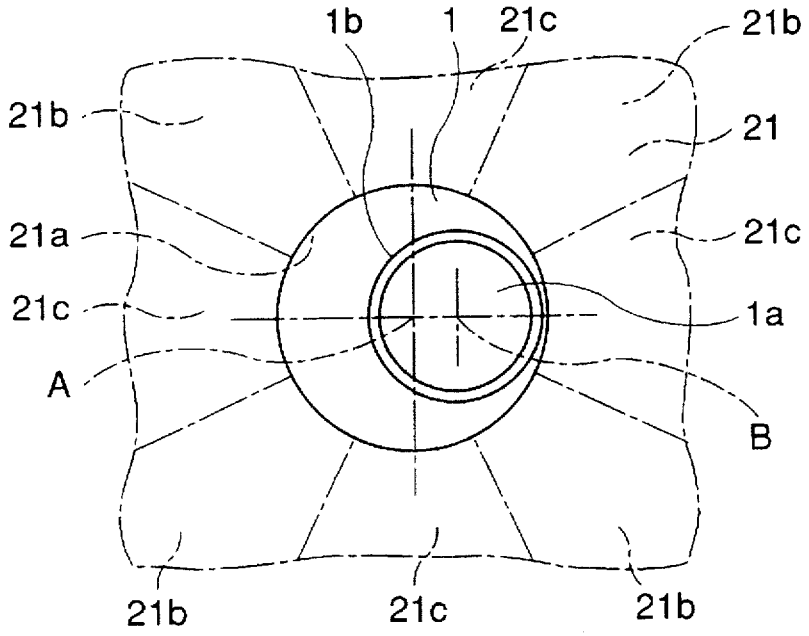
FIG. 2 is a view taken in the direction of the arrows along the line II—II.
Figure 3:
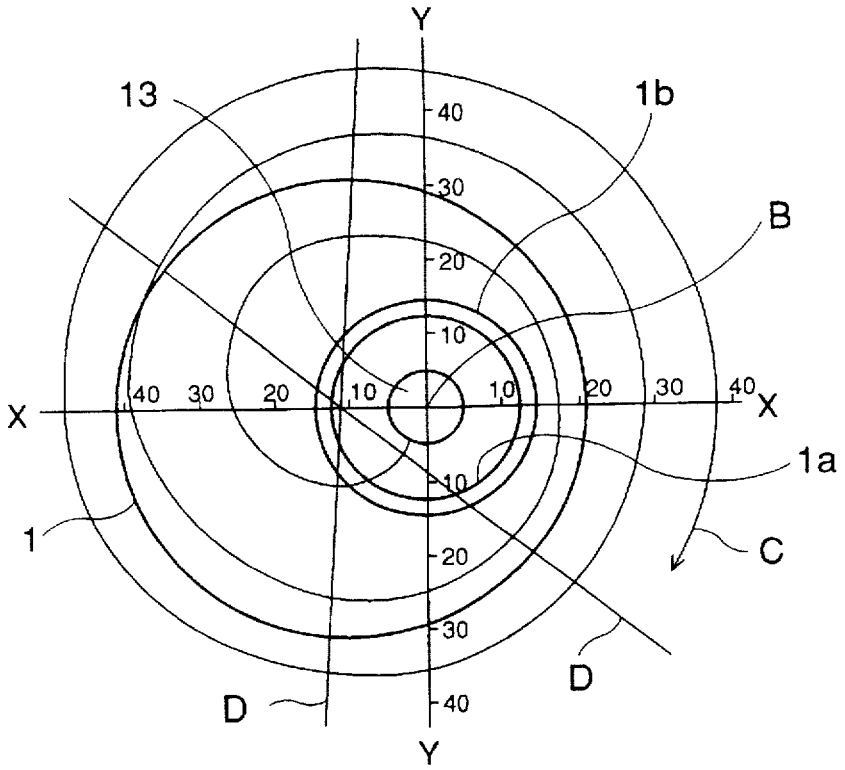
FIG. 3 is a diagrammatic view of assistance in explaining magnetic flux density distribution in a region around the center of a magnet included in the cyclotron and provided with the magnetic field adjusting center rods of FIG. 1.
Figure 4:
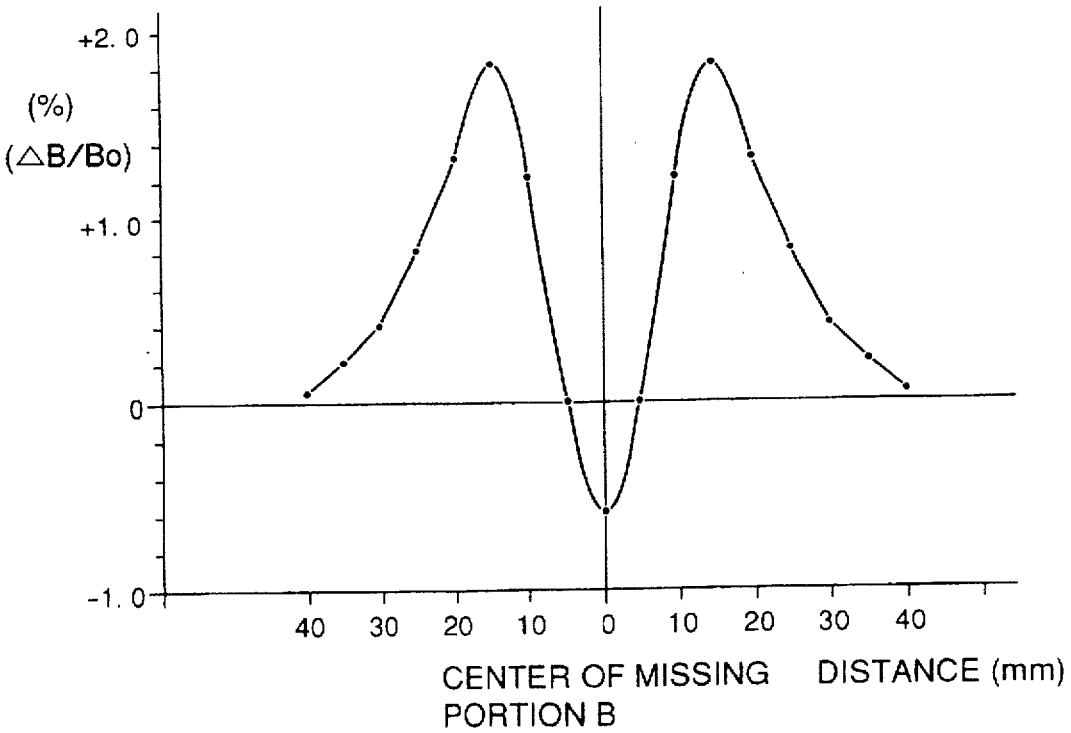
FIG. 4 is a graph showing a magnetic flux density distribution in a region around the center of a magnet having pole pieces provided with the magnetic field adjusting center rods of the present invention.

A preferred embodiment of the present invention will be described hereinafter with reference to FIGS. 1 to 4. FIG. 1 is a sectional view of magnetic field adjusting center rods in a preferred embodiment according to the present invention as mounted on a cyclotron, FIG. 2 is a view taken in the direction of the arrows along the line II—II, FIG. 3 is a diagrammatic view of assistance in explaining magnetic flux density distribution in a region around the center of a magnet included in the cyclotron and provided with the magnetic field adjusting center rods of FIG. 1, and FIG. 4 is a graph showing a magnetic flux density distribution in a region around the center of a magnet, I.E., a main magnet, having pole pieces provided with the magnetic field adjusting center rods of the present invention.

Referring to FIGS. 1 to 4, a magnet having a center axis A has a pair of pole pieces 21 and 22 disposed opposite to each other one over the other. The pole pieces 21 and 22 are provided with circular central bores 21*a* and 22*a* formed coaxially with the center axis A, respectively. Magnetic center rods 1 and 2 are inserted axially opposite to each other in the central bores 21*a* and 22*a*, respectively, so as to be axially movable along the center axis A. The upper center rod 1 is provided with an ion source receiving hole la extending in parallel to the center axis A, and the lower center rod 2 is provided with a magnetic field adjusting recess 2*a*. The ion source receiving hole 1*a* and the magnetic field adjusting recess 2*a* are coaxial with each other and have a common axis B. The ion source receiving hole 1*a* and the magnetic field adjusting recess 2*a* are eccentric to the center rods 1 and 2, respectively.

The center rods 1 and 2 are provided with magnetic field correcting projections 1*b* and 2*b* for correcting irregularities in magnetic flux density distribution formed around the open ends facing each other of the ion source receiving hole 1*a* and the magnetic field adjusting recess 2*a*, respectively.

In this embodiment the magnetic field correcting projections 1*b* and 2*b* have a continuous annular shape, however, the magnetic field correcting projections 1*b* and 2*b* may have an intermittent or discontinuous annular shape.

Although the inside diameter of the magnetic field correcting projections 1*b* and 2*b* is equal to the diameter of the ion source receiving hole 1*a* or the magnetic field adjusting recess 2*a*, the inside diameter of the magnetic field correcting projections 1*b* and 2*b* may be smaller than the diameter of the ion source receiving hole 1*a* or the magnetic field adjusting recess 2*a*, and the magnetic field correcting projections 1*b* and 2*b* may overlap the ion source receiving hole 1*a* or the magnetic field adjusting recess 2*a*. The inside diameter of the magnetic field correcting projections 1*b* and 2*b* may be greater than the diameter of the ion source receiving hole 1*a* or the magnetic field adjusting recess 2*a*.

Although the magnetic field correcting projections 1*b* and 2*b* shown in FIG. 1 have flat end surfaces, respectively, the end portions of the magnetic field correcting projections 1*b* and 2*b* may have a tapered cross section, a rounded cross section, a semicircular cross section, a triangular cross section or a trapezoidal cross section.

The height and thickness of the magnetic field correcting projections 1*b* and 2*b* are dependent on actual magnetic flux density distribution.

Figure 5:
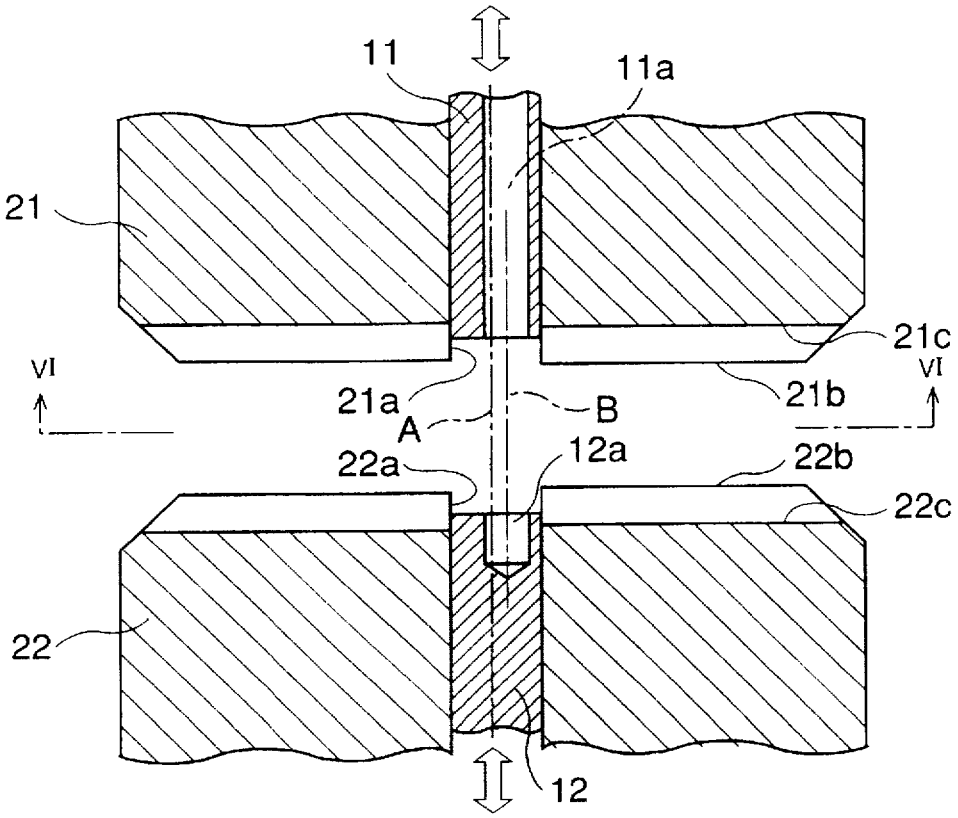
FIG. 5 is a schematic sectional view of pole pieces of a magnet included in a general cyclotron.
Figure 6:
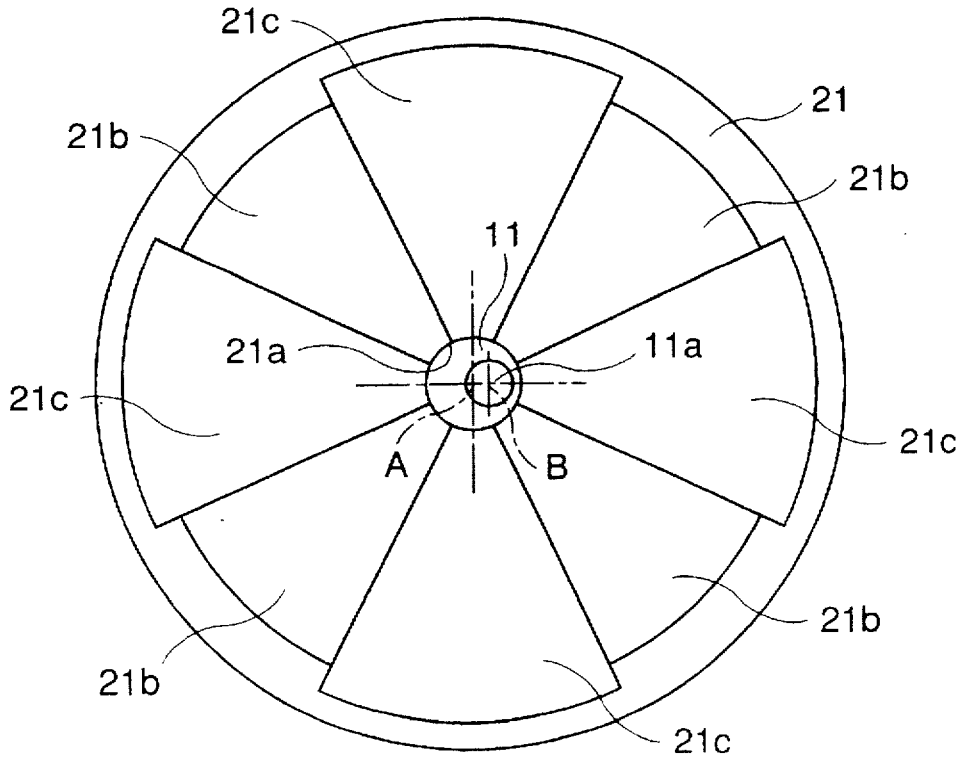
FIG. 6 is a view taken in the direction of the arrows along the line VI—VI in FIG. 5.
Figure 7:
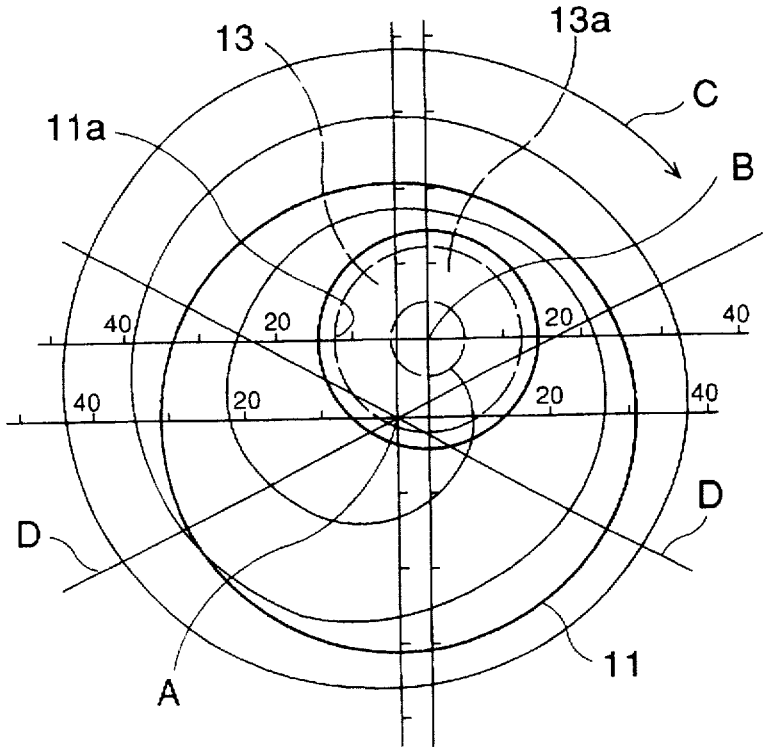
FIG. 7 is a diagrammatic view of assistance in explaining magnetic flux density distribution in a region around the center of a magnet provided with general magnetic field adjusting center rods and included in a cyclotron.
Figure 8:
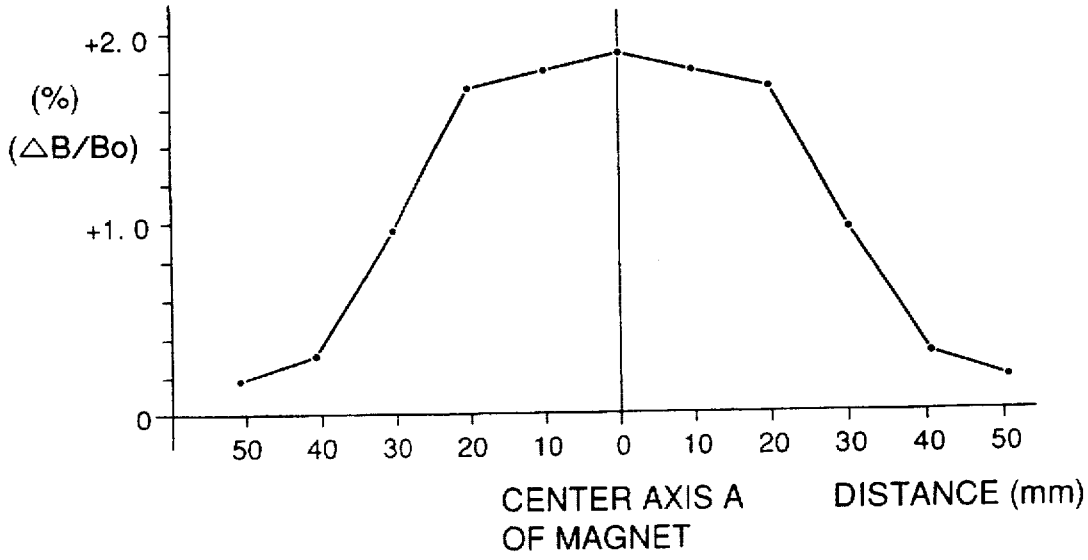
FIG. 8 is a graph showing a magnetic flux density distribution in a region around the center of a magnet corrected by the agency of magnetic field adjusting center rods.
Figure 9:
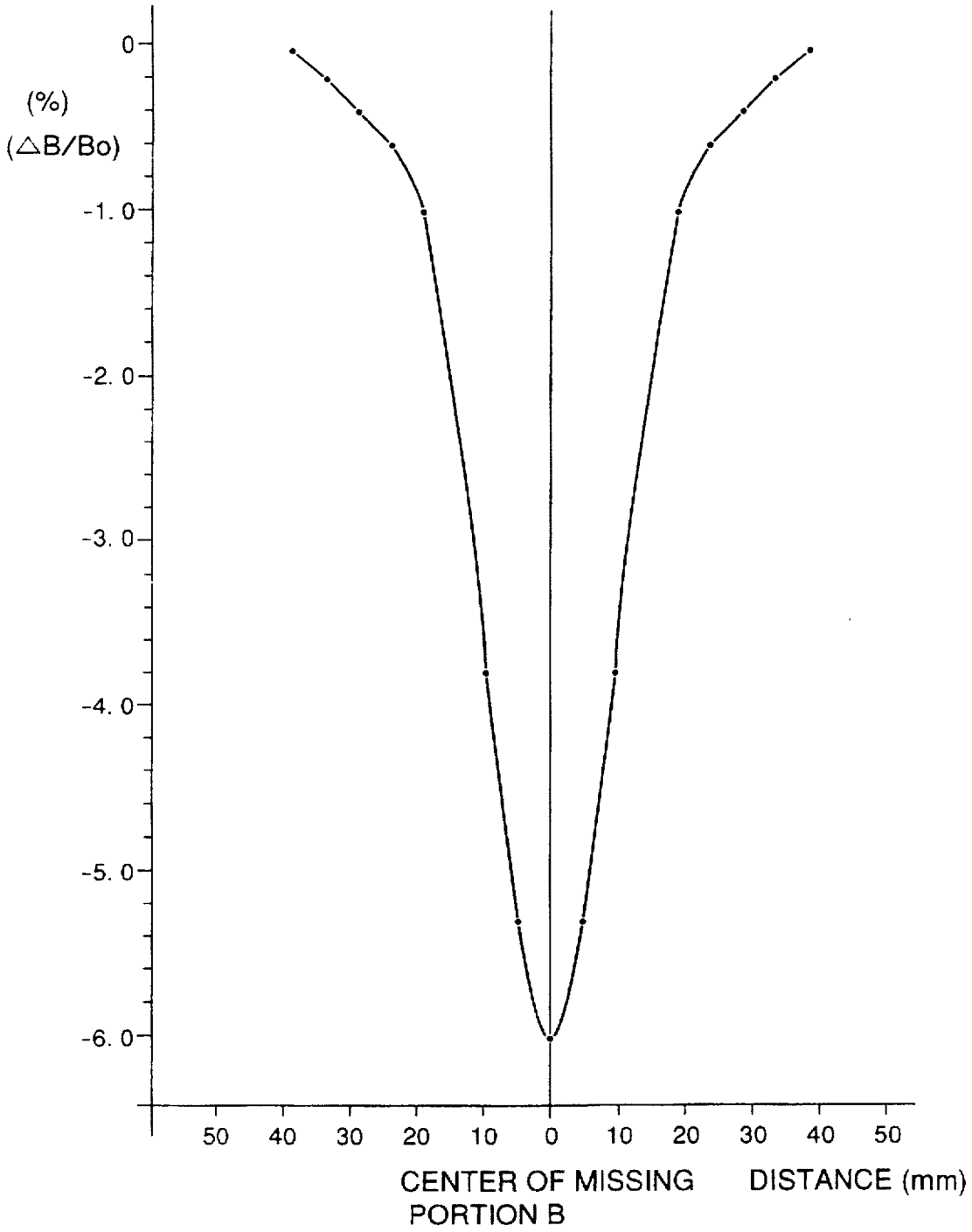
FIG. 9 is a graph showing a magnetic flux density distribution in a region around missing portions of pole pieces of a magnet provided with conventional magnetic field adjusting center rods and included in a cyclotron.

In a cyclotron provided with the mapnet provided with the magnetic field adjusting center rods 1 and 2, magnetic flux density distribution in a region around the center of the magnet, i.e., a region where portions of the pole pieces are missing, is corrected as shown in FIG. 4. The magnetic field correcting effect of the present invention is known obviously through the comparative examination of FIG. 4 showing the magnetic flux density distribution corrected by the agency of the magnetic field adjusting center rods 1*a* and 2*a* of the present invention, and FIG. 5 showing the magnetic flux density distribution corrected by the agency of the conventional magnetic field adjusting center rods not having any portion corresponding to the magnetic field correcting projections corresponding to the magnetic field correcting projections 1*b* and 2*b*. As is obvious from FIG. 4, relative magnetic flux density in the peripheral portion of the region about the center axis B of the ion source receiving hole 1*a* corresponding to the missing portion of the pole piece is comparable with an ideal relative magnetic flux density shown in FIG. 8.

Concrete example of a subminiature cyclotron in a preferred embodiment of the present invention will be described hereinafter.

Energy of Accelerated Ion

Proton: 3 MeV, Helium ion: 3 MeV

Air Gap

Land-to-land: 24 mm, Depression-to Depression: 52 mm

Mean Magnetic Field Strength 1.7 T

Power Consumption of Main Electromagnet 11 kW max.

Weight of Main Electromagnet 2 t max.

A portion of the subminiature cyclotron around the pole pieces has a structure as shown in FIG. 3, and a magnetic field created in a region around missing portions of the pole pieces has a magnetic flux density distribution as shown in FIG. 4. Since the magnetic field has the magnetic flux density distribution as shown in FIG. 4, the main electromagnet is of an energy-saving type that operates at a power consumption as low as 11 kW or below even though the air gap is ½ to ⅓ of that of the magnet of an ordinary cyclotron and the means magnetic field strength is as high as 1.7 T. Since the mean magnetic field strength is high, the outermost circular path can be formed in a small radius of 14.7 cm and the weight of the main electromagnet is 2 t or below, so that the cyclotron could be formed in a very small construction.

As is apparent from the foregoing description, according to the present invention, the pair of magnetic field adjusting center rods 1 and 2 of the cyclotron are provided around the opposite open ends of the ion source receiving hole 1*a* and the magnetic field adjusting recess 2*a* with the annular magnetic field correcting projections 1*b* and 2*b*, respectively. Therefore, irregularities in the magnetic field in a region around the ion source receiving hole 1*a* of the magnetic field adjusting center rod 1 can be corrected, so that the dispersion of ion beams in the initial stage of acceleration can be prevented, the distortion of the orbit can be limited to the least extent and hence ions can normally be accelerated.

What is claimed is:

1. A pair of magnetic field adjusting center rods for a cyclotron, for adjusting magnetic flux density distribution in a magnetic field created between a pair of pole pieces of a main electromagnet included in the cyclotron, the pair of magnetic field adjusting center rods being inserted in central portions of the pair of pole pieces opposite to each other, respectively, so as to be movable along the center axis of the pole pieces, one of the magnetic field adjusting center rods being provided with an ion source receiving hole for receiving an ion source therein extending along the center axis of the pole pieces, the other magnetic field adjusting center rod being provided with a magnetic field adjusting recess, the ion source receiving hole and the magnetic field adjusting recess having a common axis, and the pair of magnetic field adjusting center rods being provided with magnetic field correcting projections for correcting irregularities in the magnetic flux density distribution in a region around the opposite open ends of the ion source receiving hole and the magnetic field adjusting recess.

2. The magnetic field adjusting center rods according to claim 1, wherein each of the magnetic field correcting projections has an annular shape.

3. The magnetic field electromagnet center rods according to claim 1, wherein each of the magnetic field correcting projections has a circumferentially continuous annular shape.

4. The magnetic field electromagnet center rods according to claim 1, wherein each of the magnetic field correcting projections has a circumferentially intermittent annular shape.

5. The magnetic field electromagnet center rods according to claim 2, wherein each of the magnetic field correcting projections has an inside diameter equal to the diameter of the ion source receiving hole and the magnetic field adjusting recess.

6. The magnetic field electromagnet center rods according to claim 2, wherein each of the magnetic field correcting projections has an inside diameter greater than the diameter of the ion source receiving hole and the magnetic field adjusting recess.

7. The magnetic field electromagnet center rods according to claim 2, wherein each of the magnetic field correcting projections has an inside diameter smaller than the diameter of the ion source receiving hole and the magnetic field adjusting recess.

8. The magnetic field electromagnet center rods according to claim 2, wherein a projecting end portion of each of the magnetic field correcting projections has a tapered cross section.

9. The magnetic field electromagnet center rods according to claim 2, wherein a projecting end portion of each of the magnetic field correcting projections has a rounded cross section.

10. The magnetic field electromagnet center rods according to claim 2, wherein a projecting end portion of each of the magnetic field correcting projections has a semicircular cross section.

11. The magnetic field electromagnet center rods according to claim 2, wherein a projecting end portion of each of the magnetic field correcting projections has a triangular cross section.

12. The magnetic field electromagnet center rods according to claim 2, wherein a projecting end portion of each of the magnetic field correcting projections has a trapezoidal cross section.

13. A magnet for a cyclotron, comprising: a pair of pole pieces disposed opposite to each other; and a pair of magnetic field adjusting center rods disposed opposite to each other in central portions of the pair of pole pieces; respectively, so as to be movable along a common center axis of the pole pieces to adjust magnetic flux density distribution in a magnetic filed created between the pair of pole pieces of the magnet;

wherein one of the magnetic field adjusting center rods is provided with an ion source receiving hole for receiving an ion source therein extending along the common center axis of the pole pieces, the other magnetic field adjusting center rod is provided with a magnetic field adjusting recess, the ion source receiving hole and the magnetic field adjusting recess have a common axis, and the pair of magnetic field adjusting center rods are provided with magnetic field correcting projections for correcting irregularities in magnetic flux density distribution around opposite open ends of the ion source receiving hole and the magnetic field adjusting recess, respectively.

14. The magnet for a cyclotron according to claim 13, wherein each of the magnetic field correcting projections has an annular shape.

15. The magnet for a cyclotron according to claim 13, wherein each of the magnetic field correcting projections has a circumferentially continuous annular shape.

16. The magnet for a cyclotron according to claim 13, wherein each of the magnetic field correcting projections has a circumferentially intermittent annular shape.

17. The magnet for a cyclotron according to claim 13, wherein each of the magnetic field correcting projections has a wherein each of the magnetic field correcting projections has an inside diameter equal to the diameter of the ion source receiving hole and the magnetic field adjusting recess.

18. A cyclotron comprising:

a magnet having a pair of pole pieces disposed opposite to each other; and a pair of magnetic field adjusting center rods disposed opposite to each other in central portions of the pair of pole pieces, respectively, so as to be movable along a common axis of the pole pieces to adjust magnetic flux density distribution in a magnetic filed created between the pair of pole pieces of the magnet;

wherein one of the magnetic field adjusting center rods is provided with an ion source receiving hole for receiving an ion source therein extending along the common center axis of the pole pieces, the other magnetic field adjusting center rod is provided with a magnetic field adjusting recess, the ion source receiving hole and the magnetic field adjusting recess have a common axis, and the pair of magnetic field adjusting center rods are provided with magnetic field correcting projections for correcting irregularities in magnetic flux density distribution around the opposite open ends of the ion source receiving hole and the magnetic field adjusting recess, respectively.

19. The cyclotron according to claim 18, wherein each of the magnetic field correcting projections has an annular shape.

* * * * *